US005157804A

United States Patent [19]

Williams

[11] Patent Number: 5,157,804

[45] Date of Patent: Oct. 27, 1992

[54] ROLL-UP ENTRANCE FOOT MAT

[75] Inventor: Howard Williams, Muncy, Pa.

[73] Assignee: Construction Specialties, Inc., Cranford, N.J.

[21] Appl. No.: 734,552

[22] Filed: Jul. 23, 1991

[51] Int. Cl.[5] ..... A47L 23/26

[52] U.S. Cl. ..... 15/161; 15/215; 15/217; 428/53; 428/54; 52/177; 52/181

[58] Field of Search ..... 15/215, 216, 217, 161; 428/52, 53, 54; 52/177, 181

[56] References Cited

U.S. PATENT DOCUMENTS

| | | | |
|---|---|---|---|
| 2,673,365 | 3/1954 | Moor | 15/215 |
| 3,783,471 | 1/1974 | McGreary | 15/215 |
| 3,862,464 | 1/1975 | Arens | 15/217 |
| 4,590,110 | 5/1986 | Arens | 15/217 |
| 4,654,245 | 3/1987 | Balzer et al. | 428/53 |
| 4,675,222 | 6/1987 | Berndt | 428/53 |
| 4,877,672 | 10/1989 | Shreiner | 428/54 |
| 4,879,151 | 11/1989 | Ellingson | 15/215 |
| 4,952,434 | 8/1990 | Rumsey | 15/215 |

FOREIGN PATENT DOCUMENTS

| | | | |
|---|---|---|---|
| 1605028 | 12/1981 | United Kingdom | 15/217 |

*Primary Examiner*—Harvey C. Hornsby
*Assistant Examiner*—James F. Hook

[57] ABSTRACT

A foot mat comprises a multiplicity of elongated rail members formed by coextrusion of a substantially rigid polymeric material and a compressible polymeric material. Each rail member has a rigid tread-supporting web portion, at least two rigid leg portions, which are adapted to support the tread-supporting web portion stably on a surface, a cushion portion of the compressible material on the bottom of each leg portion, and a pair of rigid bulbous coupling portions of the substantially rigid material, one on each side of the tread-supporting web portion. Each coupling portion is substantially longitudinally coextensive with the tread-supporting web portion and extends generally laterally outwardly from the tread-supporting web portion. A tread member is received on the top of the tread-supporting web portion of the rail member. Each adjacent pair of rail members is joined by an elongated coupling member formed by extrusion of a metal or a polymeric material, each coupling member having a web portion and a substantially longitudinally continuous socket portion on each side of the web portion, each socket portion defining an undercut groove that opens generally laterally outwardly with respect to the web portion and receives a coupling portion of an adjacent rail member such that adjacent rail members are coupled to each other by a coupling member for articulation, whereby the mat can be rolled up.

13 Claims, 3 Drawing Sheets

ROLL-UP ENTRANCE FOOT MAT

BACKGROUND OF THE INVENTION

A type of entrance foot mat that has become increasingly popular in the nearly twenty years since it was first introduced is one composed of elongated rail members joined together in side-by-side parallel relation by a coupling arrangement that allows the mat to be rolled up. As far as the present applicant is aware, the first mat of this type to be marketed widely was introduced in the early 1970's by Construction Specialties, Inc. ("C/S"), the assignee of the present invention, under the trademark "Pedimat®." The first version of the "Pedimat®" foot mat, which is disclosed in U.S. Pat. No. 3,808,628 (Betts, May 7, 1974), comprised extruded aluminum rails joined by flexible strips that ran continuously crosswise of the rails and were joined to the rails by reception in slots in dependant side flanges of the rails having edge tabs that were crimped into engagement with the strips. The rails were spaced apart to provide gaps between adjacent rails into which dirt and water removed by the tread surfaces of the rails, which were strips of carpet, from the footwear of persons who walked across the mat could collect. Periodic cleaning of the mat and the floor under it was facilitated by rolling up the mat. The mat served its purpose of removing dirt and water very well, and the use of carpet as the tread surface made the mat aesthetically attractive. The only shortcoming of the original "Pedimat®" was a lack of durability—the flexible strips that held the rails together often tore, causing the mat to gradually break up, and the rails were sometimes bent in between the rubber strips under unusually heavy loads.

In 1975, C/S introduced a new version of the "Pedimat®" entrance foot mat, which is disclosed in U.S. Pat. No. 4,029,834 (Bartlett, Jun. 14, 1977) and is still being marketed. In that version, elongated extruded aluminum rails are joined together side-by-side by in a hinge-like fashion by longitudinally continuous ball and socket coupling arrangements that are integral with the rails; a ball on one rail is received in a socket on an adjacent rail. The ball portions of the rails ar joined to the tread portions by a web portion that has holes or slots through which dirt and water from the footwear of persons who walk across the mat fall to the floor under the mat. The present "Pedimat®" foot mats come in three styles, one with a carpet tread member, another with a vinyl tread member and the third with a grit tread member. The tread members are inserts in an extruded rail member that is used in all three versions.

Variations of the "Pedimat®" mats have been proposed, and some of the variations have been commercialized. The following U.S. patents describe and show mats similar to the all aluminum "Pedimat®" mat product:

- U.S. Pat. No. Re. 32,061 (Ellingson, Jr., Jan. 7, 1986)—extruded aluminum rails having sockets along each side joined by extruded aluminum hinge members of a "dogbone" cross section;
- U.S. Pat. No. 4,568,587 (Balzer, Feb. 4, 1986)—extruded aluminum rails with sockets along each side joined by coupling members of a flexible, extruded polymeric material, such a polyvinyl chloride, that enable the mat to be rolled up by bending of the hinge members;
- U.S. Pat. No. 4,877,672 (Shreiner, Oct. 31, 1989)—rail members tri-extruded from soft and hard polymeric materials, joined by integral balls and sockets and having living hinges formed in web portions by which the ball portions are joined to the tread portions of the rails. (C/S markets this product at the present time under the trademark "Treadline®").
- U.S. Pat. No. 4,590,110 (Arens, May 20, 1986)—brush-like tread members received in metal pans that are in turn inserted into rail members of a polymeric material, which are coupled together by metal coupling members.

Although roll-up entrance mats that include rail members or hinge members of polymeric materials are attractive and usually less expensive than all-aluminum mats, the all-aluminum mats are more durable and are considered by some people to be more attractive, because the aluminum provides a decorative accent. On the other hand, the all aluminum mats tend to rattle when walked across due to the metal-to-metal contact between the balls and sockets and some looseness in the ball and socket couplings, the looseness being inevitable because the fit between the balls and sockets has to be such that the rails can be slid together at assembly and the couplings can rotate.

SUMMARY OF THE INVENTION

One object of the present invention is to provide a roll-up entrance foot mat that is has a durability comparable to all-aluminum mats. A further object is to provide a highly durable mat that is significantly less expensive to produce than all-aluminum mats are. Still another object is to provide a foot mat that does not rattle when walked upon.

The foregoing and other objects are attained, in accordance with the present invention, by a foot mat comprising a multiplicity of elongated rail members formed by coextrusion of a substantially rigid polymeric material and a compressible polymeric material. Each rail member has a tread-supporting web portion of the substantially rigid material, at least two leg portions of the substantially rigid material depending from the bottom of the tread-supporting web portion, the leg portions being laterally spaced apart from each other, substantially coextensive with the tread-supporting web portion, and adapted to support the tread-supporting web portion stably on a surface, a cushion portion of the compressible material on the bottom of each leg portion, and a pair of bulbous coupling portions of the substantially rigid material, one on each side of the tread-supporting web portion. Each coupling portion is substantially coextensive longitudinally with the tread-supporting web portion and extends generally laterally outwardly from the tread-supporting web portion. A tread member having an upper tread surface is received on the top of the tread-supporting web portion of the rail member. The mat further includes a multiplicity of elongated coupling members formed by extrusion of a metal or a polymeric material, each coupling member having a web portion and a substantially longitudinally continuous socket portion on each side of the web portion. Each socket portion defines an undercut groove that opens generally laterally outwardly with respect to the web portion and receives a coupling portion of an adjacent rail member such that adjacent rail members are coupled to each other by a coupling member for articulation, whereby the mat can be rolled up.

In a preferred embodiment, each tread member is substantially coextensive both laterally and longitudinally of the tread-supporting web portion of the rail member on which it is received. Each socket portion of each coupling member has an upper tread surface that is generally level with the upper tread surface of the tread members of the mat. The upper tread surface of each socket portion is, preferably, treated to impart slip-resistance to it.

It is also preferable that each rail member include a side leg portion on each side, each such side leg portion having a lower part that extends laterally outwardly with respect to the tread-supporting web portion so as to underlie a corresponding coupling portion of a coupling member. A lowermost part of each socket portion of each coupling member is in close vertical clearance with an outwardly extending part of the side leg portion of the rail member to which it is joined so that a downward load on the coupling member is transferred from the lower part of each socket portion to a lower part of a side leg portion and thence to the surface upon which the mat is resting and lateral rocking motions of the rail members under downward loads on the coupling members are minimized.

Metals suitable for the foot mat are significantly more expensive than suitable polymeric materials, such as polyvinyl chloride. By making the rail members, which are much larger in size than the coupling members, of polymeric materials and making the coupling members of a suitable metal, such as aluminum, bronze or stainless steel, a substantial cost benefit, as compared to metal rail members and coupling members of polymeric material or all metal mats, is obtained. In such embodiments of a mat according to the present invention, the connections between the members are metal to polymeric material, which substantially eliminates the noise problem that exists in all-metal mats. The present invention, in preferred embodiments, eliminates the exposure of polymeric material to wear from being walked upon, inasmuch as the tread members cover substantially all of the surface of the polymeric material rail members and the metal coupling members have upper tread portions generally level with the upper surfaces of the tread members that are more resistant to wear from being walked upon, as compared to polymeric material. The durability of a mat, according to the present invention, is generally greater than that of roll-up mats of the type that rely on flexible (bendable) coupling members, which are prone to fatigue failure from repeated bending. The capability of a mat according to the invention of being rolled up results entirely from the articulating, hinge-like action of the ball and socket connections between the rail members and the coupling members.

In embodiments in which the coupling members are of polymeric material, it is advantageous to provide on the upper tread surfaces layers of an abrasive grit material. Such grit layers impart a non-slip property to the tread surfaces and increase the resistance of the coupling members to wear.

For a better understanding of the invention, reference may be made to the following description of an exemplary embodiment, taken in conjunction with the accompanying drawings.

DESCRIPTION OF THE EMBODIMENT

Figure 1:
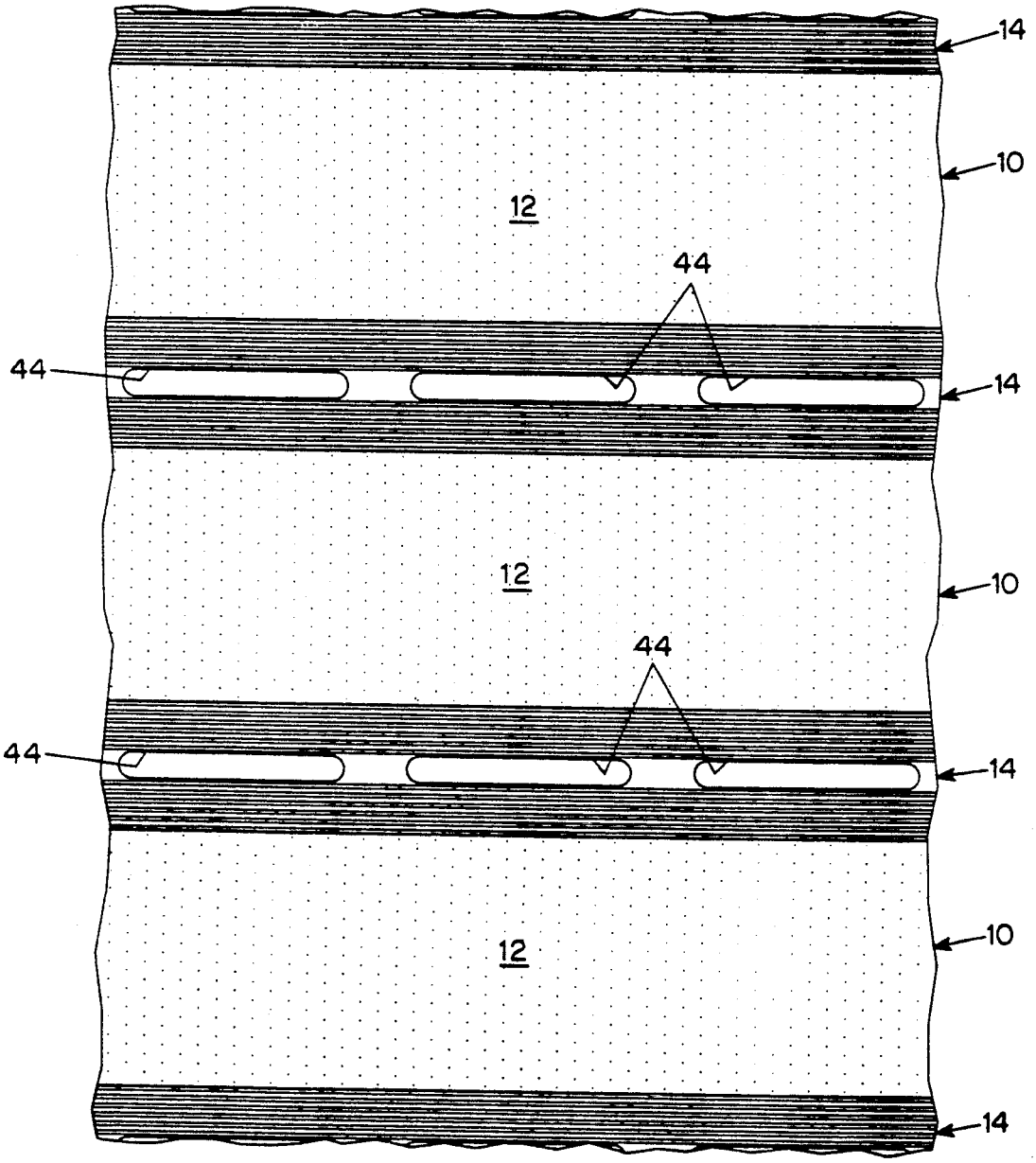
FIG. 1 is a plan view of a segment of a mat embodying the invention.

A roll-up entrance foot mat, according to the present invention, comprises a multiplicity of identical elongated rail members 10, each of which has a tread member 12 affixed to its upper surface, and a multiplicity of identical coupling members 14, each of which joins a pair of rail members to each other in side-by-side, parallel relation. Any number of rail members of any practical length (subject to manufacturing and shipping limitations) can be joined to make up a mat of any desired size and shape, and the mats can be spliced in the field upon installation laterally or longitudinally in ways presently known in the art.

The rail members 10, which are of various, interchangeable designs, are formed by coextrusion of a substantially rigid polymeric material, such as polyvinyl chloride, and a compressible polymeric material, such as a thermoplastic rubber. Each rail member has a tread-supporting web portion 16 of the substantially rigid polymeric material. Two generally L-shaped side leg portions 18 and 20 and a central, generally T-shaped leg portion 22, which are also formed of the substantially rigid polymeric material, extend continuously along the underside of the tread-supporting web portion 16. Cushion portions 24, 26, and 28 formed of the compressible polymeric material and extending along the bottom surfaces of the leg portions impart a non-slip property to the mat and also are somewhat compliant to irregularities in the surface on which the mat rests. A pair of coupling portions 30 and 32 of the substantially rigid polymeric material, one on each side of the tread-supporting web portion and each substantially longitudinally coextensive with the tread-supporting web portion 16 and of a bulbous shape, extend generally laterally outwardly from the tread-supporting web portion.

Figure 2:
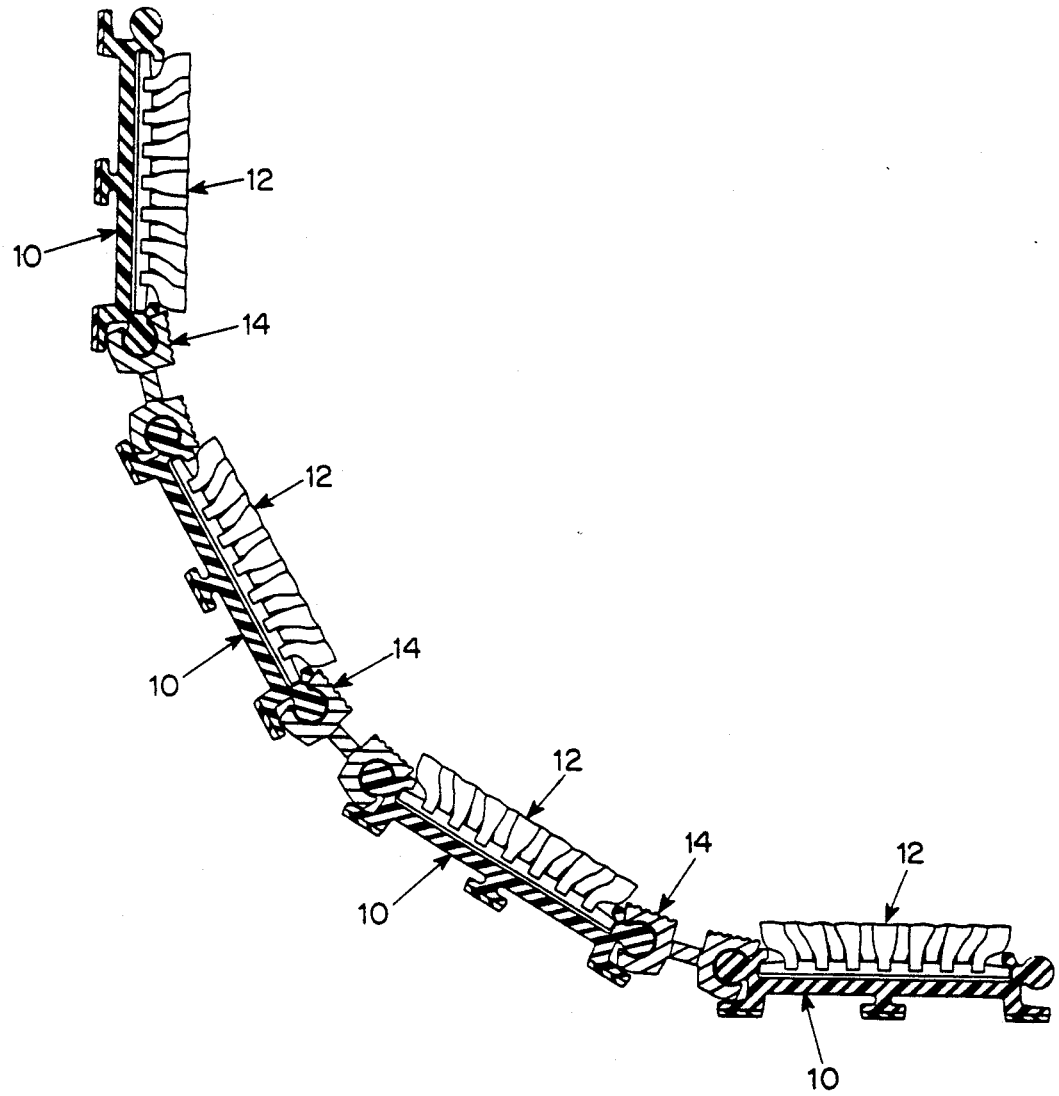
FIG. 2 is an end view of a segment of the mat of FIG. 1, a portion of the mat being shown rolled up.
Figure 6:
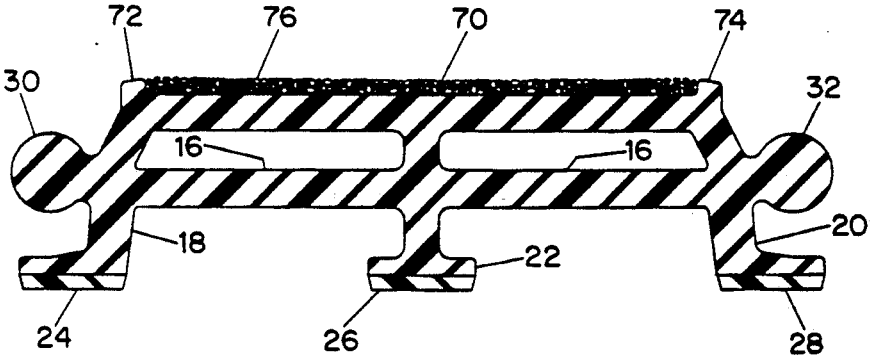
FIG. 6 is a transverse cross-sectional view of an embodiment of a rail member of the mat that is designed to receive as the tread member a layer of an abrasive grit material adhesively bonded to the tread-supporting web portion.
Figure 7:
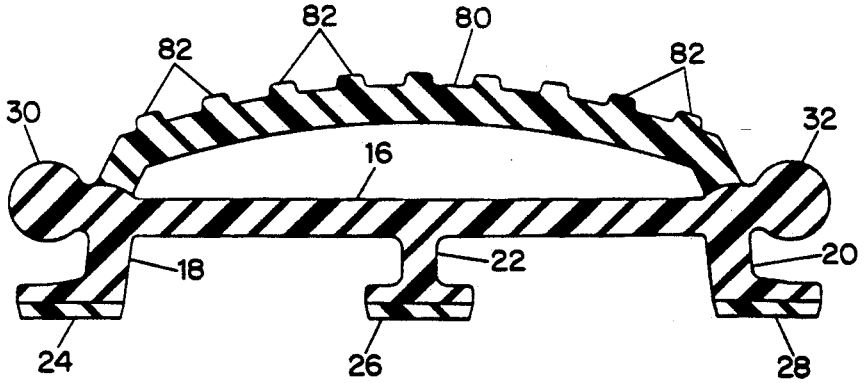
FIG. 7 is a transverse cross-sectional view of an embodiment of a rail member of the mat that has an integrally formed flexible tread member.

The tread member 12 supported on each rail member may be a strip of carpet (as shown in FIGS. 1 and 2), a band of polymeric material having a layer of grit material adhered to it (FIG. 6), or a band of a polymeric material formed with a roughened surface (FIG. 7). The tread member is either suitably fastened to the rail member, such as by an adhesive, a fusion or chemical bond, or mechanical fasteners, or is integrally formed with it and is substantially coextensive with the upper surface of the web portion in both the transverse and longitudinal directions.

Figure 8:
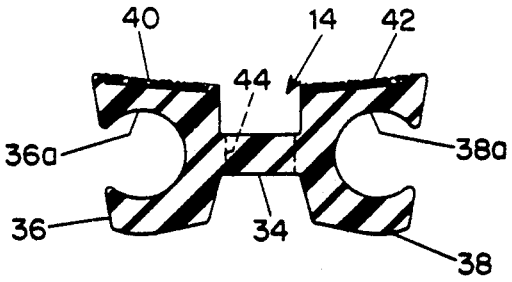
FIG. 8 is a transverse cross-sectional view of a coupling member of polymeric material.

The coupling members 14 are formed by extrusion of a metal, such as aluminum, bronze or stainless steel (FIG. 4), or of a substantially rigid polymeric material, such as polyvinyl chloride (FIG. 8). Each coupling member has a web portion 34 and a substantially longitudinally continuous socket portion 36 and 38, one on each side of the web portion. Each socket portion has an undercut groove 36a, 38a that opens generally laterally outwardly with respect to the web portion and receives a coupling portion 30 or 32 of an adjacent rail member such that adjacent rail members are coupled to each other by a coupling member for articulation (see FIG. 2) so that the mat can be rolled up for shipment, for cleaning of the surface under it and for convenient removal and transport to another location for cleaning. An upper tread surface 40, 42 that is generally level with the upper tread surfaces of the tread members 12 of the mat is provided on the upwardly facing surface of each of the coupling portions 36 and 38. Each tread surface has either integrally formed ribs (FIG. 4) or an adhesively or thermally bonded layer of abrasive grit material (FIG. 8) that imparts a non-slip property to it and enhances its wearability. Longitudinally spaced-apart holes or slots 44 formed in the web portion 34 of each coupling member provide for the passage of dirt and water from the spaces between the rail members and above the web portion onto the surface on which the mat is supported and thereby increase the dirt-capturing and storing capability of the mat.

Figure 3:
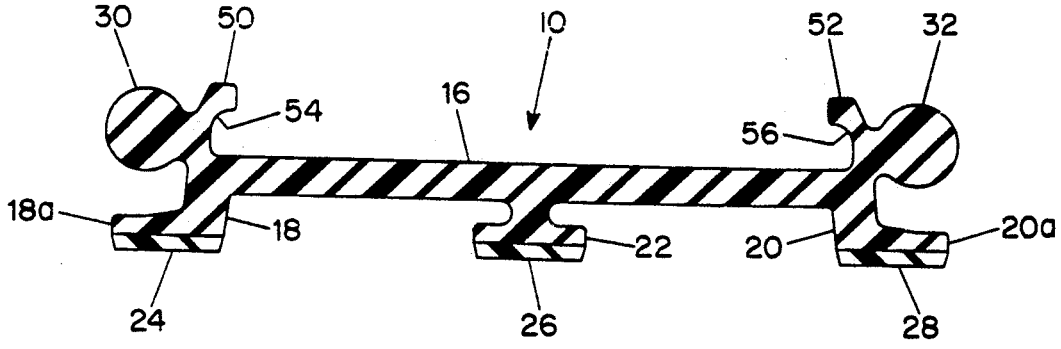
FIG. 3 is a transverse cross-sectional view of an embodiment of a rail member of the mat that is designed to receive as the tread member a replaceable carpet strip.

As may best be seen in FIG. 3, the bottom parts 18a and 20a of the side leg portions 18 and 20 of the rail members 10 extend laterally outwardly with respect to the tread-supporting web portion 16 so as to underlie a corresponding ball portion 30 or 32. The under surface of each socket portion 36, 38 of each coupling member 14 is in close vertical clearance with an outwardly extending part of the side leg portion of the rail member to which it is joined so that a downward load on the coupling member is transferred from the lower part of each socket portion to a leg portion of the rail member and thence to a surface upon which the mat is resting, and lateral rocking motions of the rail members under downward loads on the coupling members are minimized.

Except for differences in the tread-supporting web portions, the rail members 10 shown in FIGS. 3, 5, 6, and 7 are the same, and the corresponding portions are designated by the same reference numerals in those figures.

The rail member of FIG. 3 has inturned lip portions 50, 52 along each side of the web portion 16 that define grooves 54, 56 for capturing a semi-rigid backing of a replaceable carpet strip, which serves as the tread member in this form of rail (see FIG. 2). The carpet strips are mechanically fastened to the rails, such as by rivets or staples, to keep them in place endwise.

Figure 5:
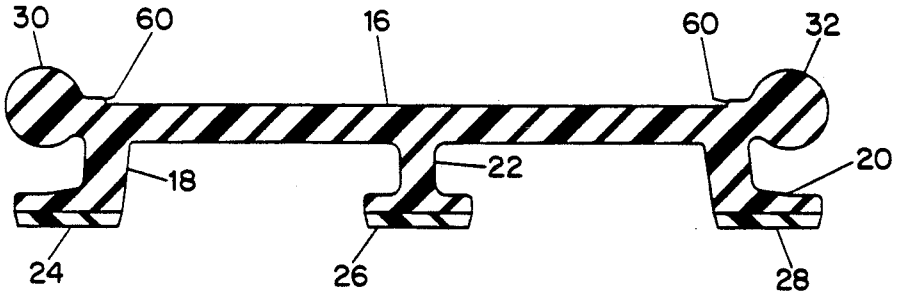
FIG. 5 is a transverse cross-sectional view of an embodiment of a rail member of the mat that is designed to receive as the tread member a carpet strip that is adhesively bonded to the tread-supporting web portion.

The rail member of FIG. 5 has a small shoulder 60, 62 along each side of the upper surface of the web portion 16 for locating the proper position of a carpet strip (not shown) that is adhesively or thermally bonded to the upper surface of the web portion.

An integrally formed band 70 of the same polymeric material as the tread-supporting web portion 16 overlies the tread-supporting web portion 16 in the rail member shown in FIG. 6. Small ribs 72, 74 along each side of the band 70 form a trough on the upper surface of the band for reception of a layer 76 of an abrasive grit material that is adhesively or thermally bonded to the upper surface of the band and serves as the tread member.

The tread member 12 of a mat made from the rail member shown in FIG. 7 is an integral band 80 of a polymeric material, such as a flexible polyvinyl chloride, that is coextruded with the rail member and has protuberances 82 on its upper surface that give it a non-slip property. The material of the band may be compounded to be softer than that of the rail member in order to impart some resilience to it for a cushioning effect when it is walked on.

Figure 4:
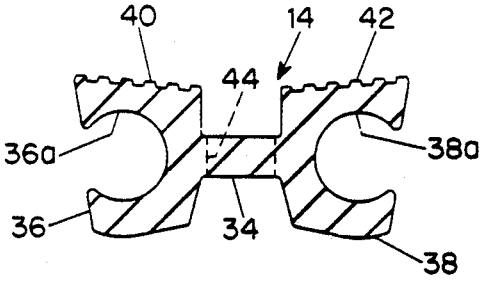
FIG. 4 is a transverse cross-sectional view of a metal coupling member.

Any of the four rail members and the corresponding tread members of FIGS. 3, 5, 6 and 7 and either of the two coupling members of FIGS. 4 and 8 can be used to make up a mat, which gives the architect or designer considerable freedom to select an aesthetically and functionally suitable design from numerous possibilities. The colors of the tread members, rail members, and coupling members can, of course, also be varied.

I claim:

1. A foot mat comprising a multiplicity of monolithic elongated rail members of a substantially rigid polymeric material and a compressible polymeric material, each rail member having a tread-supporting web portion of the substantially rigid material, at least two leg portions of the substantially rigid material depending from the bottom of the tread-supporting web portion, the leg portions being laterally spaced apart from each other, substantially coextensive with the tread-supporting web portion, and adapted to support the tread-supporting web portion stably on a surface, there being a side leg portion along each side of each rail member, a cushion portion of the compressible material on the bottom of each leg portion, and a pair of bulbous coupling portions of the substantially rigid material, one on each side of the tread-supporting web portion, each coupling portion being substantially longitudinally coextensive with the tread-supporting web portion and extending generally laterally outwardly from the tread-supporting web portion; a tread member received on the top of the tread-supporting web portion of the rail member and having an upper tread surface; and a multiplicity of monolithic elongated coupling members, each coupling member having a web portion and a substantially longitudinally continuous socket portion on each side of the web portion, each socket portion defining an undercut groove that opens generally laterally outwardly with respect to the web portion and receives a coupling portion of an adjacent rail member such that adjacent rail members are coupled to each other by a coupling member for articulation, whereby the mat can be rolled up, each side leg portion having a lower part that extends laterally outwardly with respect to the tread-supporting web portion so as to underlie a corresponding coupling portion of a coupling member, and a lowermost part of each socket portion of each coupling member being in close vertical clearance with an outwardly extending part of the side leg portion of the rail member to which it is joined so that a downward load on the coupling member is transferred from the lower part of each socket portion to a lower part of a side leg portion and thence to the surface upon which the mat is resting and lateral rocking motions of the rail members under downward loads on the coupling members are minimized.

2. A foot mat according to claim 1 wherein each tread member is substantially coextensive both laterally and longitudinally of the tread-supporting web portion of the rail member on which it is received.

3. A foot mat according to claim 2 wherein each socket portion of each coupling member has an upper tread surface that is generally level with the upper tread surface of the tread members of the mat.

4. A foot mat according to claim 1 wherein each rail member has inturned lip portions along each side of the web portion that define grooves for capturing a semi-rigid backing of a replaceable carpet strip, which serves as the tread member.

5. A foot mat according to claim 1 wherein each rail member is adapted to receive as the tread member a carpet strip that is adhesively bonded to the upper surface of the tread-supporting web portion.

6. A foot mat according to claim 1 wherein the tread member is an integrally formed band of a polymeric material that overlies the tread-supporting web portion and has a layer of an abrasive grit material that is bonded to the upper surface of the band.

7. A foot mat according to claim 1 wherein the tread member is a band of a polymeric material that is integral with the rail member and has protuberances on its upper surface that give it a non-slip property.

8. A foot mat according to claim 7 wherein the material of the band is compounded to be softer than that of the rail member in order to impart some resilience to it for a cushioning effect when it is walked on.

9. A foot mat according to claim 1 wherein each coupling member is metal.

10. A foot mat according to claim 1 wherein each coupling member is a substantially rigid polymeric material.

11. A foot mat according to claim 3 wherein each coupling member is a substantially rigid polymeric material.

12. A foot mat according to claim 11 wherein each of the upper tread surfaces of each coupling member have a layer of an abrasive grit material bonded to them that imparts a non-slip property to the tread surface and increases wearability.

13. A foot mat according to claim 1 wherein each rail member is adapted to receive as the tread member a carpet strip that is thermally bonded to the upper surface of the tread-supporting web portion.

* * * * *